62-21 SF
1/28/86 OR 4,566,887

United States Patent [19]
Openshaw

[11] Patent Number: 4,566,887
[45] Date of Patent: Jan. 28, 1986

[54] PRODUCTION OF PURE NITROGEN

[75] Inventor: Ronald D. Openshaw, Cheshire, England

[73] Assignee: Costain Petrocarbon Limited, Manchester, United Kingdom

[21] Appl. No.: 531,252

[22] Filed: Sep. 12, 1983

[30] Foreign Application Priority Data

Sep. 15, 1982 [GB] United Kingdom ..... 8226290

[51] Int. Cl.[4] ..... F25J 3/04
[52] U.S. Cl. ..... 62/21; 26/34; 26/37; 26/38; 26/39
[58] Field of Search ..... 62/23, 24, 27, 28, 29, 62/31, 32, 34, 38, 39, 21, 37

[56] References Cited

U.S. PATENT DOCUMENTS 4,372,764 2/1983 Theobald ..... 62/38

*Primary Examiner*—Frank Sever
*Attorney, Agent, or Firm*—Birch, Stewart, Kolasch & Birch

[57] ABSTRACT

A process and apparatus for the production of nitrogen from air by the cryogenic fractionation of the air at superatmospheric pressure and which permits the production of variable quantities of nitrogen from a constant supply of air at superatmospheric pressure by periodically distilling less than all of the air which is supplied at superatmospheric pressure and work expanding a stream of air at superatmospheric pressure provided from the balance of said supply whereby to produce additional refrigeration for the process, and recovering condensed nitrogen vapor thereby formed in excess of that required for reflux.

17 Claims, 2 Drawing Figures

PRODUCTION OF PURE NITROGEN

Figure 1:
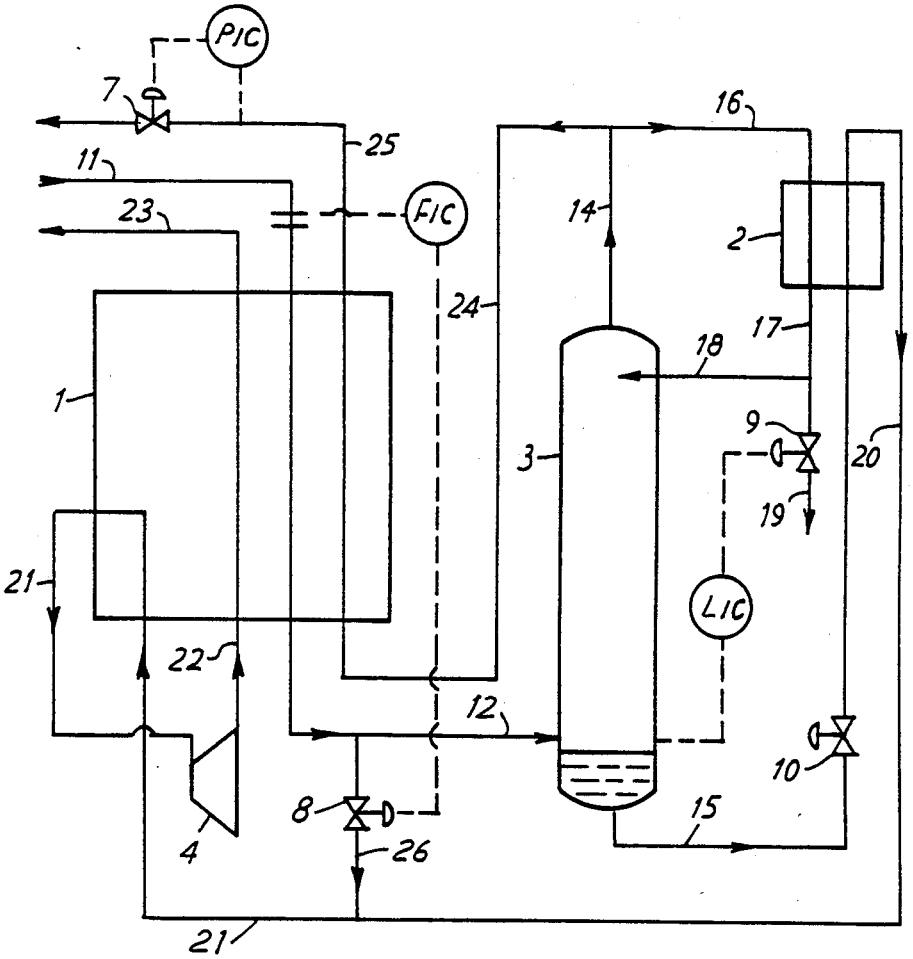

This invention relates to the production of nitrogen by its cryogenic separation from air and in particular to a process which permits a variable rate of supply of nitrogen from a relatively constant supply of compressed air.

A known process for the production of pure nitrogen by cryogenic air separation consists in compressing air to a superatmospheric pressure, usually about 9 bar abs, purifying the air of components which would solidify at the temperatures employed, e.g. by removing most of the water content by cooling the air to about 5° C. with a refrigeration unit and eliminating the remainder of the water vapour and the carbon dioxide contained in the air by adsorption on molecular sieves or a similar material, cooling the compressed purified air to a temperature close to its dew-point, and feeding the cooled air to the base of a distillation column from which the nitrogen is recovered overhead.

Reflux for the distillation is supplied by expanding to an intermediate pressure the oxygen-rich liquid leaving the column base and evaporating said liquid in heat exchange with a portion of the nitrogen vapour leaving the top of the column whereby to condense said vapour. A second portion of the nitrogen vapour is recovered as product. The evaporated oxygen-rich liquid recovered from the reflux condenser is thereafter expanded in a turbine to near atmospheric pressure, preferably after being pre-heated to avoid liquid formation in the turbine, thus producing the refrigeration required to maintain the process. The cooling of the compressed purified air is effected by passing it in countercurrent with the nitrogen product and expanded oxygen-rich vapour in a main heat exchanger wherein said nitrogen product and oxygen-rich vapour are warmed to near ambient temperature. The preheating of the oxygen-rich vapour prior to expanding may also be effected in this main heat exchanger. In general, the refrigeration available will permit the condensation of more of the nitrogen vapour than is required for reflux, thus providing a source of liquid nitrogen which can be recovered and stored. However, in general only about 5–10% of the total nitrogen production can be made available in this form, the actual amount depending on the size of the plant.

Since on many industrial sites nitrogen is required intermittently for purging equipment and similar purposes, there is a growing demand for plants able to increase liquid production during periods in which little or no gaseous nitrogen is required, this liquid nitrogen to be stored in insulated tanks for use in subsequent periods of higher nitrogen demand. In conventional cryogenic nitrogen processes and plants of the kind described above the output of liquid nitrogen is independent of the amount of gaseous nitrogen delivered and cannot be increased by reducing the output of gaseous nitrogen.

The present invention provides a modification of a nitrogen process plant of the kind described above which enables the output of liquid nitrogen to be significantly increased during periods in which the requirement for gaseous nitrogen is low, thereby increasing the capability of the process and plant to satisfy intermittent periods of high nitrogen demand.

An increased production of liquid nitrogen requires an increase in the amount of refrigeration supplied and, in conventional plants, this is limited by the amount of oxygen-rich gas available and the pressure at which it can be fed to the expansion turbine. In conventional operation the amount of oxygen-rich gas available is approximately 60% of the air treated and the maximum pressure at which it can be fed to the expansion turbine is about 5.0 bar abs.

In periods during which the demand for gaseous nitrogen is low, it is not necessary to feed the same quantity of air to the distillation column as in periods of high demand, and in conventional plants it is customary to reduce the flow of air during such periods by suction-throttling the air compressor. This leads to some reduction in power comsumption, but does not permit more liquid nitrogen to be produced because there is no increase in the flow of oxygen-rich vapour through the turbine and hence the amount of refrigeration provided.

In the process of this invention, only a part of the air is fed to the distillation column during periods of low gas demand and the remainder is work-expanded, either by joining the oxygen-rich waste gas stream after throttling to intermediate pressure, or by passing at full pressure to a separate expander. By means of this arrangement, additional refrigeration is produced thereby enabling more nitrogen to be withdrawn as liquid and this liquid can then be stored to use in a subsequent period of increased nitrogen demand.

Thus according to the present invention, there is provided a process for the production of nitrogen from air by cooling and distilling a supply of air at superatmospheric pressure to produce a nitrogen-rich vapour stream and an oxygen-containing liquid residue, recovering a first portion of said vapour as product nitrogen gas, condensing a second portion of said vapour by indirect heat exchange with oxygen-containing liquid residue which has been expanded to an intermediate pressure, to provide reflux for the distillation, and providing refrigeration for the process by work-expanding evaporated oxygen-containing liquid residue recovered from said indirect heat exchange, said process further comprising periodically distilling less than all of the air which is supplied at superatmospheric pressure and work expanding a stream of air at superatmospheric pressure provided from the balance of said supply whereby to produce additional refrigeration for the process, and recovering condensed nitrogen vapour thereby formed in excess of that required for reflux.

The liquid nitrogen thereby produced may be stored and in a subsequent period of operation, when demand for nitrogen gas exceeds the plant's capacity, the output of the plant may be supplemented from this store. By this means, therefore, it is possible to provide a variable supply of nitrogen from the plant while maintaining the supply of compressed air constant. Further plant flexibility is offered by the alternative of supplying at least a part of the liquid nitrogen as such, as it is produced and/or after storage.

In one embodiment of the process, which is more suitable for use in relatively small plants, the stream of air that is to be work-expanded is expanded to an intermediate pressure and combined with the oxygen-containing liquid residue which has been evaporated producing the condensed nitrogen vapour, and the combined stream is work expanded. By means of this embodiment, only one expansion engine is required.

In another alternative embodiment, which is more suitable for use in relatively larger plants, e.g. delivering at least about 1000 $Nm^3$/hr of nitrogen, the stream of air and the evaporated oxygen-containing liquid residue are separately work expanded. Conveniently, however, the two work-expanded streams may then be combined into a single stream for subsequent indirect heat exchange with the feed air supply to cool the latter.

Preferably expansion turbines are used which may be radial inward-flow air-lubricated machines. In the second-mentioned embodiment, the turbines may be equipped with variable nozzles, in which case the two machines may be interchangeable. It is then no longer essential for the user to carry a spare turbine, since, if one machine should fail, operation can continue although without the production of the additional liquid nitrogen.

In general, the process may be controlled so that the proportion of the compressed air supply which is fed to the distillation is varied to match the demand for nitrogen gas. Preferably the whole of the remainder of the supply of compressed air, when the nitrogen gas demand is low, is subjected to the work expansion since this will maximise the production of net available condensed nitrogen vapour e.g. for storage.

The invention also provides apparatus for the production of nitrogen by compressing a supply of air to superatomospheric pressure, and after removing water vapour and carbon dioxide cooling it and subjecting the compressed air to separation by cryogenic distillation wherein the condensation of a portion of the nitrogen vapour recovered overhead to provide reflux for the distillation is effected by indirect heat exchange with evaporating oxygen-containing liquid residue of the distillation and refrigeration for the process is provided by work expanding evaporated oxygen-containing liquid residue recovered from the reflux condenser, said apparatus further including valve, conduit and work expansion means for intermittently diverting from the distillation a portion of the air supplied at superatomospheric pressure, work expanding it and passing the work-expanded stream in indirect heat exchange with the feed to the distillation to provide additional refrigeration and means for recovering and optionally storing the excess condensed nitrogen vapour so obtained.

In accordance with one embodiment, said apparatus may include means for providing a supply of purified air at superatmospheric pressure main heat exchange means distillation means having an inlet for air at superatmospheric pressure, an inlet for column reflux, a first outlet for nitrogen-rich vapour and a second outlet for oxygen-containing liquid residue reflux condensing means first and second expansion valve means expansion engine means having an inlet and outlet for gas to be expanded optionally at least one insulated storage tank for liquid nitrogen, said tank being provided with an inlet for the liquid nitrogen and a valved outlet first conduit means for directing air at superatmospheric pressure from said air supply means through said main heat exchange means to said distillation means inlet second conduit means for directing a first portion of nitrogen vapour from said distillation means first outlet through said main heat exchanger means in couter-current indirect heat exchange relationship with said air in said first conduit means and recovering said vapour as product nitrogen gas third conduit means for directing a second portion of nitrogen from said distillation means first outlet through said reflux condensing means whereby to condense said nitrogen vapour fourth conduit means for directing a first portion of condensed nitrogen vapour recovered from said reflux condenser means to said distillation means reflux inlet as reflux for the distillation fifth conduit means for recovering a second portion of condensed nitrogen vapour from said reflux condensing means and optionally directing it to said at least one insulated storage tank sixth conduit means for directing oxygen-containing liquid residue from said distillation means second outlet through said first expansion valve means and then through said reflux condensing means in indirect heat exchange relationship with condensing nitrogen vapour in said third conduit and thence to the inlet of said expansion engine means seventh conduit means for directing gas from the outlet of said expansion engine means through said main heat exchanger means in indirect counter-current heat exchange relationship with said air at superatmospheric pressure in said first conduit means eighth conduit means for directing air at superatmospheric pressure from said air supply means through said second expansion valve means to said sixth conduit means downstream of said reflux condensing means, and valve means for controlling the flow of air in said eighth conduit means.

In accordance with another embodiment, the apparatus includes means for providing a supply of purified air at superatmospheric pressure main heat exchange means distillation means having an inlet for air at superatmospheric pressure, an inlet for column reflux, a first outlet for nitrogen-rich vapour and a second outlet for oxygen-containing liquid residue reflux condensing means expansion valve means first and second expansion engine means each having an inlet and outlet for gas to be expanded optionally at least one insulated storage tank for liquid nitrogen, said tank being provided with an inlet for the liquid nitrogen and a valved outlet first conduit means for directing air at superatmospheric pressure from said air supply means through said main heat exchange means to said distillation means inlet second conduit means for directing a first portion of nitrogen vapour from said distillation means first outlet through said main heat exchanger means in counter-current indirect heat exchange relationship with said air in said first conduit means and recovering said vapour as nitrogen product gas third conduit means for directing a second portion of nitrogen vapour from said distillation means first outlet through said reflux condensing means whereby to condense said nitrogen vapour fourth conduit means for directing a first portion of condensed nitrogen vapour recovered from said reflux condenser means to said distillation means reflux inlet fifth conduit means for recovering a second portion of condensed nitrogen vapour from said reflux condensing means and optionally directing it to said at least one insulated storage tank sixth conduit means for directing oxygen-containing liquid residue from said distillation means second outlet through said expansion valve means and then through said reflux condensing means in indirect heat exchange relationship with condensing nitrogen vapour in said third conduit and thence to the inlet of said first expansion engine means seventh conduit means for directing gas from the outlet of said first expansion engine means through said main heat exchanger means in indirect counter-current heat exchange relationship with said air at superatmospheric pressue in said first conduit means eighth conduit means for directing air at superatmospheric pressure from said air supply means to the inlet of said second expansion engine means ninth conduit means for directing air from the outlet of said second expansion engine means through the main heat exchanger means in indirect counter-current heat exchange relationship with said air at superatmospheric pressure in said first conduit means, and means for controlling the flow of air in said eighth conduit means.

In both embodiments, between the reflux condensing means and the first expansion engine means said sixth conduit will normally pass through a part of the main heat exchange means at or towards the cold end thereof, superheat the oxygen-containing liquid residue which has been evaporated in said reflux condensing means to a temperature such that after expansion in the expansion engine it will be at or just above its dew point.

Likewise, in the second embodiment, it is preferred that the eighth conduit connects with said first conduit means to divert air therefrom at a point within said main heat exchange means corresponding to a temperature such that after expansion through said second expansion engine means the air is at or just above its dew point.

The apparatus may suitably include a valve adapted to control flow in said eighth conduit means and means responsive to pressure and/or flow changes in the compressed air supply and/or product nitrogen gas for controlling said valve whereby a fall in the rate of flow of said product nitrogen gas below a predetermined level opens said valve and a rise in said rate of flow closes said valve and at rates of flow of said product nitrogen gas below said predetermined value the rate of flow of air through said eighth conduit is proportional to the difference between the actual product nitrogen gas flow rate and said predetermined value.

Figure 2:
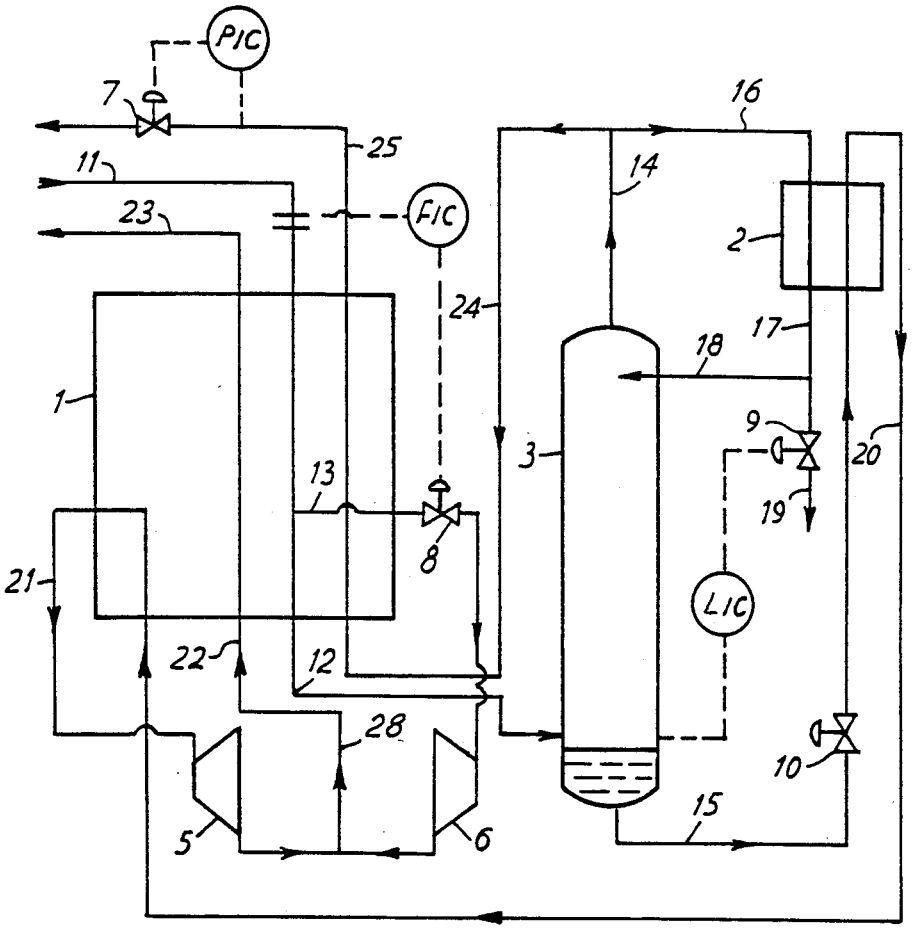

The invention will now be described in greater detail with reference to preferred embodiments thereof and with the aid of the accompanying drawings in which FIG. 1 is a flow diagram of one embodiment of the invention wherein there is provision for a part of the compressed air supply to be combined with the evaporated oxygen-containing liquid recovered from the reflux condenser for subsequent work expansion, and FIG. 2 is a flow diagram of an alternative embodiment wherein there is provision for a part of the compressed air supply to be expanded separately from the evaporated oxygen-containing liquid.

In the figures the numerals 1 and 2 represent heat exchanges, 3 is a distillation column, 4, 5 and 6 are expansion turbines, 7, 8 and 9 are automatically controlled valves, 10 is a manually adjustable valve, which can be set as required, PIC represents a pressure-responsive controller and FIC represents a flow-responsive controller.

In the embodiment shown in FIG. 1 air, which has been compressed e.g. to about 9 bar abs., and from which moisture and carbon dioxide have been removed by conventional means, enters heat exchanger 1 through line 11 at near ambient temperature and is cooled to a temperature slightly below its dew-point in counter-current heat exchange with gaseous nitrogen product in line 24, and a waste gas, the nature of which is identified below, in line 22. Leaving the exchanger the air feed can divide into two streams passing through lines 12 and 26, respectively. Control is provided by valve 8.

In one mode of operation, suitable for use in periods when demand for nitrogen gas is high, the whole of the air feed passes through line 12 to the base of the distillation column 3 in which it is separated into a pure nitrogen overhead stream leaving through line 14 and an oxygen-containing liquid, which leaves through line 15. This liquid is a first employed as the coolant for reflux condenser heat exchanger 2. To this end it must first be expanded to an intermediate pressure, e.g. approximately 5.0 bar abs. in the valve 10 and is then passed to the reflux condenser 2 wherein it is evaporated thereby condensing a first part of the nitrogen overhead stream from the column which is withdrawn through line 16. The condensed nitrogen leaves the condenser through line 17, at least a part being returned through line 18 to the column as reflux and any remainder, in line 19, being drawn off through level-controlled valve 9 as liquid nitrogen product. The remainder of the overhead nitrogen stream is recovered in line 24, passed through heat exchanger 1 where it is warmed to near ambient temperature and recovered through line 25 and pressure-controlled valve 7 as nitrogen product gas.

The evaporated oxygen-containing liquid leaving the reflux condenser in line 20 is passed via line 21 to the expansion turbine 4, in which it is work-expanded to near atmospheric pressure. Leaving the turbine through line 22, it is warmed to near ambient temperature in exchanger 1 in countercurrent heat exchange with the compressed air, finally leaving through line 23. Before entering the turbine, the stream in line 21 is superheated in heat exchanger 1, as illustrated, to the degree necessary to avoid liquid formation occurring in the expansion turbine. To ensure the proper heat exchange in exchanger 1, this stream is so superheated that when work expanded in the expansion turbine the outlet temperature is just above or at the dew point of the expanded stream.

In accordance with the invention, provision is made via conduit 26 to divide a portion of the compressed air from line 12 when demand for nitrogen product gas is low and, after expanding it through valve 8 to about the same pressure as the evaporated oxygen-rich liquid in line 20, to inject it in line 20 whereby it is expanded with the evaporated oxygen-rich liquid in expansion turbine 4. This increases the amount of refrigeration produced and thus also the amount of nitrogen liquid that is produced. The excess over that required for reflux is recovered through line 19.

One arrangement for automatic control of the plant is now described. In a first mode of operation, the demand for nitrogen gas from line 25 equals the capacity of the plant and valve 8 is closed. When demand for nitrogen gas increases, the Pressure Indicator Controller (PIC) will throttle to maintain the system pressure. A reduction in demand, on the other hand, will initially cause a rise in pressure and the PIC will open fully. If demand continues to fall, the further increase in pressure can be employed by any suitable means, e.g. a suction control valve on the air compressor (not shown), to decrease the air flow in line 11. This reduction in flow is then detected by the Flow Indicator Controller (FIC) which is arranged to open valve 8 whereupon the pressure falls thereby causing the suction control valve to reopen and restore the flow in line 11.

The opening of valve 8 permits the process to move to a second mode wherein the air flow in line 26, which is the excess of the compressed air supply over and above that required to satisfy the reduced demand for nitrogen gas, is expanded through said valve into the evaporated oxygen-rich liquid in line 20 and thence passed to expansion turbine 4 thereby increasing the refrigeration delivered to heat exchanger 1. This results in an increase in the proportion of liquid in the air to the distillation column which in turn allows for the withdrawal of a greater proportion of the reflux as liquid nitrogen product. This can be achieved without affecting the purity of the nitrogen product since the nitrogen product rate is low and the reflux available is much greater than necessary to achieve the desired separation of nitrogen from air.

A portion of the compressed air in line 12 will continue to flow through line 26 while the demand for nitrogen is below that obtainable from the full air supply.

When demand for nitrogen gas is subsequently increased, the system pressure will decrease and flow in line 11 will tend to increase. This flow increase is detected by the FIC which will act to throttle valve 8 to restore the correct flow in line 11. When valve 8 is fully closed, whereby all the compressed air in line 11 is fed to the distillation column, the system reverts to its first mode of operation and any further increase in demand for nitrogen gas will cause the PIC to throttle to maintain system pressure, as before. Means may be provided for then automatically opening a valve in the outlet from a liquid nitrogen storage tank in which liquid nitrogen produced during the second mode of operation has been stored, whereby to supply additional nitrogen from that source to satisfy the increased demand for nitrogen gas.

An alternative embodiment of the invention is illustrated in FIG. 2 in which all parts and conduits common with the arrangement of FIG. 1 are identified by the same reference numerals. While otherwise arranged and operating in substantially the same manner as that of FIG. 1, in this embodiment turbine 4 is replaced by two turbines 5 and 6 through which respectively the evaporated oxygen-containing liquid and any compressed air diverted from line 11 (in this case through line 13) are separately expanded before being combined in line 28 and passed through main heat exchanger 1 as the refrigerant stream.

In order to provide the compressed air stream to the turbine 6 at the desired temperature such that the expanded air leaving the turbine at about atmospheric pressure is at about its dew point and substantially no liquid formation occurs in the turbine, this air is withdrawn from the main feed line 11 at an appropriate point in main heat exchanger 1, e.g. corresponding to a temperature of about 130 K. For the same reason, the evaporated oxygen-containing liquid recovered from the reflux condenser heat exchanger 2 in line 20 is first superheated to about 120 K. in the main heat exchanger 1 before being passed to the turbine 5.

In this second embodiment of the invention, two alternative methods of operation are applicable in periods in which the demand for gaseous nitrogen is low and a high rate of production of liquid nitrogen is desired.

In the first method of operation, which is preferable when the low demand for gaseous nitrogen is restricted to a relatively short period, such as a night shift or week-end, the flow of oxygen-containing liquid residue is left unchanged; i.e., the setting of valve 10 is not altered. As in the embodiment of FIG. 1, the valve 8 is operated to divert through line 13, expansion turbine 6 and line 28, the excess of the compressed air feed in line 11, over and above that required to satisfy the reduced demand for nitrogen gas. A significant increase is thus obtained in the output of liquid nitrogen through valve 9.

If the low demand for gaseous nitrogen is to continue for an extended period, a further increase in liquid nitrogen output can be obtained in accordance with a second method of operation by adjusting the setting of valve 10 to reduce the flow of oxygen-rich liquid from the bottom of the column and hence the flow of vapour to turbine 5. To maintain the total flow of air to the plant, the flow indicator controller (FIC) will then automatically divert a larger flow of air through valve 8 to the auxiliary turbine 6, thereby resulting in a further increased output of liquid nitrogen.

The reduction of flow through valve 10 with the consequent increase of flow through valve 8 can be continued as long as the resulting reduced flow of air to the column is adequate to satisfy the hydraulic requirements of the trays and downcomers. In a typical arrangement, the minimum flow of air to the column to satisfy these requirements is approximately 45% of normal loading. However, greater degrees of turn-down are possible by suitable choice of column design, as is known in the art.

The invention is now illustrated but in no way limited by the following Examples.

EXAMPLE 1

In this Example, nitrogen gas was produced from a compressed air supply delivered in line 11 at about 9 bar abs. and 12° C. using the arrangement illustrated in FIG. 1 of the accompanying drawings. In a first mode of operation, valve 8 was closed and in conventional manner all the compressed air supply in line 11 was passed to the distillation column 3. The resultant flows are recorded in Column A of Table 1 below. The arrangement was then switched to a second mode in which only about two-thirds of the compressed air supply was fed to the column, the remaining one-third being diverted through valve 8 and pipeline 26 to be expanded in turbine 4. The resultant flows are recorded in Column B of Table 1 from which it can be seen that the net production of liquid nitrogen for storage is doubled.

TABLE 1

| Flows | A $Nm^3/hr$ | B $Nm^3/hr$ |
|---|---|---|
| Compressed Air Supply (Line 11) | 1570 | 1570 |
| Air to Distillation Column (Line 12) | 1570 | 1050 |
| Total Waste gas supplied to turbine 4 (Line 21) | 960 | 1480 |
| Compressed Air diverted through valve 8 to turbine 4 (Line 26) | — | 520 |
| Product Nitrogen Gas (Line 25) | 570 | 10 |

TABLE 1-continued

| Flows | A $Nm^3/hr$ | B $Nm^3/hr$ |
|---|---|---|
| Liquid Nitrogen make (Line 19) | 40 | 80 |

EXAMPLE 2

In this Example, nitrogen gas was again produced from a compressed air supply delivered in line 11 at about 9 bar abs. and 12° C. but using the arrangement illustrated in FIG. 2 of the accompanying drawings.

In a first mode of operation, valve 8 was closed and in a conventional manner all the compressed air supply in line 11 was passed to distillation column 3. The resultant flows are recorded in Column A of Table 2 below. The arrangement was then switched to a second mode in which only about 70% of the compressed air supply in line 11 was fed to the column, the remaining 30% being diverted through line 13 and valve 8 to be expanded in turbine 6. The resultant flows are recorded in Column B of Table 2. In a third mode, valve 10 was throttled until only 45% of the air in line 11 was passed to the column. The resultant flows are recorded in Column C of Table 2.

TABLE 2

| | A $Nm^3/hr$ | B $Nm^3/hr$ | C $Nm^3/hr$ |
|---|---|---|---|
| Compressed Air Supply (Line 11) | 4540 | 4540 | 4540 |
| Air to Distillation Column (Line 12) | 4540 | 3280 | 2040 |
| Evaporated oxygen-containing liquid to Turbine 5 (Line 20/21) | 2770 | 2770 | 1490 |
| Compressed Air diverted to Turbine 6 (Line 13) | — | 1260 | 2500 |
| Product Nitrogen Gas (Line 25) | 1616 | 222 | 225 |
| Liquid Nitrogen make (Line 9) | 154 | 288 | 325 |

From the Table, it can be seen that in the second mode of operation (Column B) the liquid nitrogen output is increased over that of the conventional mode (Column A) by a factor of 1.87. In the third mode of operation (Column C) the factor is increased to 2.11.

I claim:

1. An Apparatus for the production of nitrogen by compressing a supply of air to superatmospheric pressure and after removing water vapour and carbon dioxide cooling it and subjecting the compressed air to separation by cryogenic distillation wherein the condensation of a portion of the nitrogen vapour recovered overhead to provide reflux for the distillation and optionally some liquid nitrogen as product is effected by indirect heat exchange with evaporating oxygen-containing liquid residue of the distillation and refrigeration for the process is provided by work expanding evaporated oxygen-containing liquid residue recovered from the reflux condenser, said apparatus further includes means designed for regulating the output of nitrogen in accordance with a variable demand of nitrogen gas by increasing the output of liquid nitrogen in periods of reduced demand for nitrogen gas, said means comprising valve, conduit and work expansion means for periodically diverting from the distillation a portion of the air supplied at superatmospheric pressure, work expanding it and passing the work-expanded stream in indirect heat exchange with the feed to the distillation to provide additional refrigeration and means for recovering and optionally storing the excess condensed nitrogen vapour so obtained.

2. Apparatus as claimed in claim 1, including means for providing a supply of purified air at superatmospheric pressure main heat exchange means distillation means having an inlet for air at superatmospheric pressure, an inlet for column reflux, a first outlet for nitrogen-rich vapour and a second outlet for oxygen-containing liquid residue reflux condensing means first and second expansion valve means expansion engine means having an inlet and outlet for gas to be expanded optionally, at least one insulated storage tank for liquid nitrogen, said tank being provided with an inlet for the liquid nitrogen and a valved outlet first conduit means for directing air at superatmospheric pressure from said air supply means through said main heat exchange means to said distillation means inlet second conduit means for directing a first portion of nitrogen vapour from said distillation means first outlet through said main heat exchanger means in counter-current indirect heat exchange relationship with said air in said first conduit means and recovering said vapour as product nitrogen gas third conduit means for directing a second portion of nitrogen vapour from said distillation means first outlet through said reflux condensing means whereby to condense said nitrogen vapour fourth conduit means for directing a first portion of condensed nitrogen vapour recovered from said reflux condenser means to said distillation means reflux inlet as reflux for the distillation fifth conduit means for recovering a second portion of condensed nitrogen vapour from said reflux condensing means and optionally directing it to said at least one insulated storage tank sixth conduit means for directing oxygen-containing liquid residue from said distillation means second outlet through said first expansion valve means and then through said reflux condensing means in indirect heat exchange relationship with condensing nitrogen vapour in said third conduit and thence to the inlet of said expansion engine means seventh conduit means for directing gas from the outlet of said expansion engine means through said main heat exchanger means in indirect counter-current heat exchange relationship with said air at superatmospheric pressure in said first conduit means eighth conduit means for directing air at superatmospheric pressure from said air supply means through said second expansion valve means to said sixth conduit means downstream of said reflux condensing means, and valve means for controlling the flow of air through said eighth conduit means.

3. Apparatus as claimed in claim 2 including a valve associated with said eighth conduit means and means responsive to pressure and/or flow changes in the compressed air supply and/or product nitrogen gas for controlling said valve whereby a fall in the rate of flow of said product nitrogen gas below a predetermined level opens said valve and a rise in said rate of flow closes said valve and at rates of flow of said product nitrogen gas below said predetermined value the rate of flow of air through said eighth conduit is proportional to the difference between the actual product nitrogen gas flow rate and said predetermined value.

4. Apparatus as claimed in claim 1 including means for providing a supply of purified air at superatmospheric pressure main heat exchange means distillation means having an inlet for air at superatmospheric pressure, an inlet for column reflux, a first outlet for nitrogen-rich vapour and a second outlet for oxygen-containing liquid residue reflux condensing means expansion valve means first and second expansion engine means each having an inlet and outlet for gas to be expanded optionally at least one insulated storage tank for liquid nitrogen, said tank being provided with an inlet for the liquid nitrogen and a valved outlet first conduit means for directing air at superatmospheric pressure from said air supply means through said main heat exchange means to said distillation means inlet second conduit means for directing a first portion of nitrogen vapour from said distillation means first outlet through said main heat exchanger means in counter-current indirect heat exchange relationship with said air in said first conduit means and recovering said vapour as nitrogen product gas third conduit means for directing a second portion of nitrogen vapour from said second conduit after the said distillation means first outlet through said reflux condensing means whereby to condense said nitrogen vapour fourth conduit means for directing a first portion of condensed nitrogen vapour recovered from said reflux condenser means to said distillation means reflux inlet fifth conduit means for recovering a second portion of condensed nitrogen vapour from said reflux condensing means and optionally directing it to said at least one insulated storage tank sixth conduit means for directing oxygen-containing liquid residue from said distillation means second outlet through said expansion valve means and then through said reflux condensing means in indirect heat exchange relationship with condensing nitrogen vapour in said third conduit and thence to the inlet of said first expansion engine means seventh conduit means for directing gas from the outlet of said first expansion engine means through said main heat exchanger means in indirect counter-current heat exchange relationship with said air at superatmospheric pressure in said first conduit means eighth conduit means for directing air at superatmospheric pressure from said air supply means to the inlet of said second expansion engine means ninth conduit means for directing air from the outlet of said second expansion engine means through the main heat exchanger means in indirect counter-current heat exchange relationship with said air at superatmospheric pressure in said first conduit means, and means for controlling the flow of air in said eighth conduit means.

5. Apparatus as claimed in claim 4 including a valve associated with said eighth conduit means and means responsive to pressure and/or flow changes in the compressed air supply and/or product nitrogen gas for controlling said valve whereby a fall in the rate of flow of said product nitrogen gas below a predetermined level opens said valve and a rise in said rate of flow closes said valve and at rates of flow of said product nitrogen gas below said predetermined value the rate of flow of air through said eighth conduit is proportional to the difference between the actual product nitrogen gas flow rate and said predetermined value.

6. Apparatus as claimed in claim 4 including a variable area nozzle control means on the second expansion engine and means responsive to pressure and/or flow changes in the compressed air supply and/or product nitrogen gas for controlling said variable area nozzle control means whereby a fall in the rate of flow of said product nitrogen gas below a predetermined level opens said variable area nozzle control means and a rise in said rate of flow closes said variable area nozzle control means and at rates of flow of said product nitrogen gas below said predetermined value the rate of flow of air through said eighth conduit is proportional to the difference between the actual product nitrogen gas flow rate and said predetermined value.

7. A process for the production of nitrogen gas and liquid from air comprising:

cooling and distilling a supply of air at superatmospheric pressure to produce a nitrogen rich vapor stream and an oxygen-containing liquid residue;

recovering a first portion of said vapor as product nitrogen gas;

condensing a second portion of said vapor by indirect heat exchange with oxygen-containing liquid residue which has been expanded to an intermediate pressure, thereby providing reflux for the distillation and optionally some liquid nitrogen as product and providing refrigeration for the process by work-expanding evaporated oxygen-containing liquid residue recovered from said indirect heat exchange;

regulating the output of nitrogen gas and liquid in accordance with a variable demand of nitrogen gas whereby the output of liquid nitrogen is increased in periods of reduced demand for nitrogen gas by periodically distilling less than all of the air which is supplied at superatmospheric pressure and work-expanding a stream of air at superatmospheric pressure provided from the balance of said supply whereby to produce additional refrigeration for the process; and recovering condensed nitrogen vapor thereby formed in excess of that required for reflux.

8. The process as claimed in claim 7, wherein said stream of air is expanded to an intermediate pressure and combined with the oxygen-containing liquid residue which has been evaporated by said indirect heat exchange, and the combined stream is work expanded.

9. The process as claimed in claim 7, wherein said stream of air and said oxygen-containing liquid residue which has been evaporated by said indirect heat exchange are separately work-expanded.

10. An apparatus for the production of nitrogen gas and liquid from air which comprises:

a distillation column;

means for introducing a flow of compressed air into said distillation column whereby a nitrogen-rich gas stream is recovered at the top of the distillation column and an oxygen-containing liquid stream is recovered at the bottom of the distillation column;

a valve means;

means for introducing at least a portion of said oxygen-containing liquid stream recovered from the bottom of the distillation column to the valve means for expansion therein;

means for effecting an indirect heat exchange between a portion of the nitrogen-rich gas stream recovered from the top of the distillation column and the expanded oxygen-containing liquid stream recovered from the value means whereby the expanded oxygen-containing liquid stream is evaporated and the portion of the nitrogen-rich gas stream recovered from the top of the distillation column is condensed and returned to the distillation column as reflux and a portion thereof optionally recovered as a liquid nitrogen product;

a work expansion means;

means for passing the evaporated oxygen-containing liquid stream through the work expansion means;

means for passing the work-expanded oxygen-containing stream in indirect heat exchange with the flow of compressed air to be introduced into the distillation column to refrigerate the flow of compressed air, and recovering the work-expanded oxygen-containing stream;

means for recovering a portion of the nitrogen-rich gas stream recovered at the top of the distillation column as a gaseous nitrogen product; and means designed for regulating the output of nitrogen gas and liquid in accordance with a variable demand for nitrogen gas whereby the output of liquid nitrogen is increased in periods of reduced demand for nitrogen gas, said means including:

means for periodically diverting a portion of the flow of compressed air to be introduced into the distillation column, combining the diverted compressed air stream with the evaporated oxygen-containing liquid stream, passing the combined stream through the work expansion means, passing the combined work-expanded stream in indirect heat exchange with the flow of compressed air to be introduced into the distillation column to refrigerate the compressed air, and recovering the combined stream.

11. The apparatus as recited in claim 10, wherein the means designed for regulating the output of nitrogen gas and liquid in accordance with a variable demand whereby the output of liquid nitrogen is increased in periods of reduced demand for nitrogen gas further includes:

valve means;

means for passing the portion of the compressed air diverted from the distillation column through said valve means;

means, responsive to pressure and/or flow changes in the stream of compressed air being introduced into the distillation column and/or product nitrogen gas, for controlling the valve whereby a fall in the rate of flow of the product nitrogen gas below a predetermined level opens the valve and a rise in the rate of flow of the product nitrogen gas closes the valve and at rates of flow of the product nitrogen gas below the predetermined level the rate of flow of the compressed air to the expansion means is proportional to the difference between the actual product nitrogen gas flow rate and the predetermined level.

12. The apparatus as recited in claim 10, which further comprises means to superheat the combined stream before it is passed through the work-expansion means.

13. The apparatus as recited in claim 10, which further comprises means for passing a portion of the nitrogen-rich gas stream recovered at the top of the distillation column in indirect heat exchange with the flow of compressed air to be introduced into the distillation column whereby the nitrogen-rich gas stream is heated and recovered as a gaseous nitrogen product.

14. An apparatus for the production of nitrogen gas and liquid from air which comprises:

a distillation column;

means for introducing a flow of compressed air into said distillation column whereby a nitrogen-rich gas stream is recovered at the top of the distillation column and an oxygen-containing liquid stream is recovered at the bottom of the distillation column;

a valve means;

means for introducing at least a portion of said oxygen-containing liquid stream to the valve means for expansion therein;

means for effecting an indirect heat exchange between a portion of the nitrogen-rich gas stream recovered from the top of the distillation column and at least a portion of the oxygen-containing liquid stream recovered from the bottom of the distillation column whereby the oxygen-containing liquid stream is evaporated and the portion of the nitrogen-rich gas stream recovered from the top of the distillation column is condensed and returned to the distillation column as reflux and a portion thereof optionally recovered as a liquid nitrogen product;

a first work expansion means;

means for passing the evaporated oxygen-containing stream through the first work expansion means;

means for passing the work-expanded oxygen-containing liquid stream in indirect heat exchange with the flow of compressed air to be introduced into the distillation column to refrigerate the flow of compressed air, and recovering the work-expanded oxygen-containing stream;

means for recovering a portion of the nitrogen-rich gas stream recovered at the top of the distillation column as a gaseous nitrogen product; and means designed for regulating the output of nitrogen gas and liquid in accordance with a variable demand for nitrogen gas whereby the output of liquid nitrogen is increased in periods of reduced demand for nitrogen gas, said means including:

means for periodically diverting a portion of the flow of compressed air to be introduced into the distillation column, passing the diverted stream of compressed air through a second work expansion means, combining the diverted stream of compressed air which has been work-expanded with the work-expanded oxygen-containing stream and passing the combined stream in indirect heat exchange with the flow of compressed air to be introduced into the distillation column to refrigerate the flow of compressed air, and recovering the combined stream.

15. The apparatus as recited in claim 14, wherein the means designed for regulating the output of nitrogen gas and liquid in accordance with a variable demand whereby the output of liquid nitrogen is increased in periods of reduced demand for nitrogen gas further includes:

valve means;

means for passing the portion of the compressed air diverted from the distillation column through said valve means;

means responsive to pressure and/or flow changes in the stream of compressed air being introduced into the distillation column and/or product nitrogen gas, for controlling the valve whereby a fall in the rate of flow of the product nitrogen gas below a predetermined level opens the valve and a rise in the rate of flow of the product nitrogen gas closes the valve and at rates of flow of the product nitrogen gas below the predetermined level the rate of flow of the compressed air to the expansion means is proportional to the difference between the actual product nitrogen gas flow rate and the predetermined level.

16. The apparatus as recited in claim 14, which further comprises means to superheat the evaporated oxygen-containing liquid stream recovered from the bottom of the distillation column before it is passed through the first work-expansion means.

17. The apparatus as recited in claim 14, which further comprises means for passing a portion of the nitrogen-rich gas stream recovered at the top of the distillation column in indirect heat exchange with the flow of compressed air to be introduced into the distillation column whereby the nitrogen-rich gas stream is heated and recovered as a gaseous nitrogen product.

* * * * *